US005419227A

United States Patent [19]

Lavineway

[11] Patent Number: 5,419,227

[45] Date of Patent: May 30, 1995

[54] TREMOLO APPARATUS

[76] Inventor: Sheldon D. Lavineway, 12911-109 Avenue, Surrey, B.C., Canada, V3T 2N1

[21] Appl. No.: 171,933

[22] Filed: Dec. 22, 1993

[51] Int. Cl.[6] ..... G10D 3/00

[52] U.S. Cl. ..... 84/313

[58] Field of Search ..... 84/313, 298

[56] References Cited

U.S. PATENT DOCUMENTS

| | | | |
|---|---|---|---|
| 2,741,146 | 4/1956 | Fender | 84/313 |
| 4,171,661 | 10/1979 | Rose | 84/313 |
| 4,497,236 | 2/1985 | Rose | 84/298 |
| 4,555,970 | 12/1985 | Rose | 84/313 |
| 4,782,732 | 11/1988 | Kato et al. | 84/313 |
| 4,823,669 | 4/1989 | Sarricola | 84/313 |
| 4,928,564 | 5/1990 | Borisoff et al. | 84/313 |
| 4,939,971 | 7/1990 | Satoh | 84/313 |
| 5,109,745 | 5/1992 | Tomita | 84/313 |
| 5,127,298 | 7/1992 | Snape et al. | 84/313 |
| 5,194,679 | 3/1993 | Cohen | 84/313 |

FOREIGN PATENT DOCUMENTS

| | | | |
|---|---|---|---|
| 855961 | 11/1970 | Canada | 84/37 |

*Primary Examiner*—M. C. Gellner
*Assistant Examiner*—Patrick J. Stanzione

[57] ABSTRACT

A tremolo for a multiple stringed musical instrument such as guitar is provided having independently movable plates each of which support one or more guitar strings. A sliding clip may be provided which engages adjacent plates and may be used to selectively provide a tremolo effect simultaneously on all of the strings of the instrument or on a portion of the strings. A tremolo arm is provided for each plate so that when the plates are disengaged, each plate may be independently operated to produce a tremolo effect on a portion of the strings of the instrument. A spring operated tremolo return apparatus is provided for maintaining the tremolo in a neutral position. Saddles which engage with the plates of the tremolo are provided which facilitate rapid string changes.

11 Claims, 4 Drawing Sheets

TREMOLO APPARATUS

TECHNICAL FIELD

This invention relates to tremolos for stringed musical instruments.

BACKGROUND OF THE INVENTION

Tremolos for stringed musical instruments are known. Such devices are used to decrease the tension of the strings of the instrument to lower its tone, or to increase tension of the strings raising the tone. Such devices may be adapted for use in a variety of stringed instruments, typically multiple-stringed instruments such as guitars, cellos, mandolins, etc.

A tremolo device is typically provided with a lever or tremolo arm used to effect a movement in the tremolo thereby increasing or decreasing tension on the guitar strings. In an electric guitar, tremolo arm is often called a "whammy bar". The tremolo of an electric guitar is typically located adjacent the transducers located on the body of the guitar. Typically, such tremolos include means for fixing an end of each of a number guitar strings and means for bridging the guitar strings adjacent the fixed ends of the strings. Often the means for fixing the string end and bridging the string is provided in a saddle separable from a string support plate of the tremolo. The string support plate is pivotally mounted relative to the body of the guitar and its pivotal movement is actuated by the tremolo arm. Pivotal engagement of the string support plate with the guitar body may be provided by a number of known means, including a hinge apparatus such as the trunnions of Canadian patent no. 855,961, or the knife-edge articulating means described in U.S. Pat. No. 4,171,661. Often, a tremolo is pivotally mounted on the body of an electric guitar over a cavity in the body of sufficient size to permit the string support plate of the tremolo to pivot into or towards the cavity when increased tension on the guitar strings is effected. Typically, a tremolo lever such as a flange depends from a side of the string support plate facing the cavity and extends into the cavity. As is shown in U.S. Pat. Nos. 2,741,146 and 4,171,661, the tremolo lever may be connected to the guitar body by a resilient element such as a spring within the cavity. Such resilient means are used to counteract tension of the guitar strings so as to maintain the tremolo at a neutral point at which the guitar is tuned. Such an arrangement is often called a floating tremolo, although fixed stops may be incorporated to limit the lever or the bridge support plate of the tremolo.

As a tremolo's primary function is to affect the string tension, it is not essential that the tremolo include means for fixing a string end or for bridging the string since such means may be provided elsewhere on the guitar body adjacent the tremolo device. For example, the tremolo may include means to fix a guitar string end whereas the bridge is provided on the guitar body adjacent the tremolo. A variety of string fixation means are known which rely upon either restraint of a bead mounted on the end of the string, clamping the string, or both methods.

Until now, advances in design of tremolos have related to the bridging and string fixation means, or in the means for locating and stabilizing the pivotal movement of a tremolo in order to maintain the instrument in tune during extended use of the tremolo or after string breakage. Prior to this invention, tremolos simultaneously affected all of the strings engaged by the tremolo without provision for a differential effect with respect to different strings.

SUMMARY OF THE INVENTION

This invention provides a tremolo for a multiple-stringed musical instrument comprising a plurality of independently moveable support plates, each string support plate having means for attachment of a tremolo arm to the plate and means for pivotal connection of the plate to a body of the musical instrument. When used with a multiple stringed instrument such as a guitar, each of the string support plates of the tremolo may be used to affect one or more strings of the instrument. By actuating the tremolo arm of a particular string support plate, one may produce a tremolo effect with respect to certain strings of the instrument while not affecting others. For example, a tremolo of this invention may be used with a six-string electric guitar where one string support plate affects the top three strings (E, A, and D) while a second adjacent bridge support plate affects the remaining strings (G, B, and E). If the player decides to play rhythm on strings E, A, and D, the remaining strings are open to play lead, and vice versa. The player may change key by actuating a selected tremolo arm to raise or lower the notes on which the player is playing lead, without moving hand position, and without losing the base note being played. The player may play a full six-note chord without losing the base note of the chord, yet still have a tremolo effect on the upper or lower strings.

DETAILED DESCRIPTION OF THE INVENTION

Figure 1:
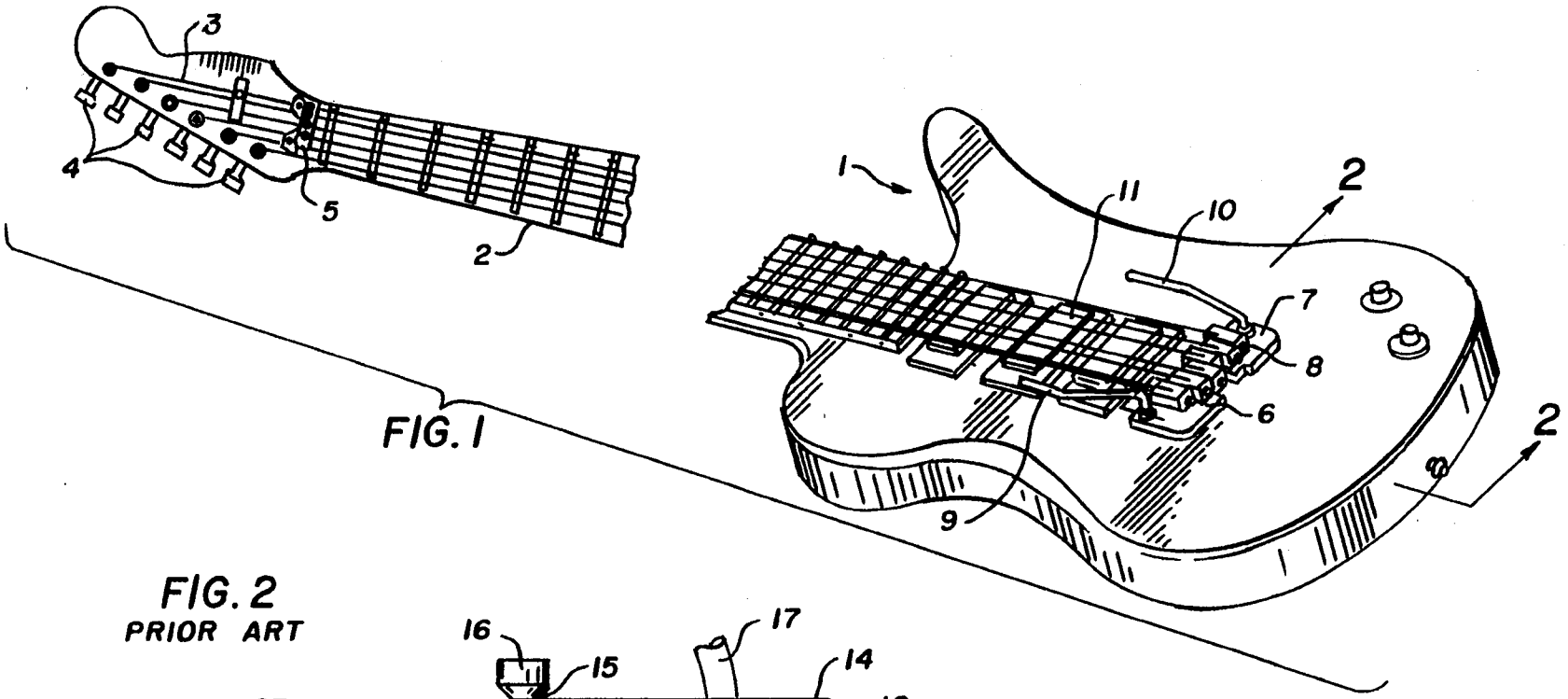
FIG. 1 is a perspective view of a six-string electric guitar with a tremolo of this invention.

A tremolo of this invention may resemble tremolos of the prior art in respect of the functional elements of the tremolo except that in this invention, the tremolo is divided into at least two independently moveable parts which affect separate strings or groups of strings. In the case of a tremolo having a pivot means consisting of a fulcrum ridge or knife-edge fulcrum engaged with pins or other elements on the guitar body, it is possible to provide this invention by insuring that independent fulcrum means are provided on each of the string support plates of this invention. For example, each string support plate may have a knife-edge fulcrum at opposite corners of a leading edge of the plate and the guitar body has a plurality of pins for engagement of each knife-edge fulcrum of each string support plate. In the case of tremolos having a form of hinge which allows for pivoting relative to the instrument body, each string support bridge of this tremolo may be provided with such a hinge. Preferably, a tremolo of this invention will use a hinge as the pivotal means and most preferably, such a hinge will have a common pivot element supporting all of the string support plates of the tremolo. For example, the pivot element may be an elongate hinge pin extending across the tremolo, engaging and supporting each adjacent string support plate, with ends of the hinge pin extending beyond opposite sides of the tremolo to pivotally engage with mounting elements, such as brackets, mountable on the instrument body.

Where it is desired to provide a double-acting tremolo such as is described in U.S. Pat. No. 4,939,971, each string support plate of this invention may be provided as upper and lower plates, each having pivot means.

Except in the case of a tremolo that is designed to pivot relative to the instrument body and not engage within a cavity in the instrument body such as that described in Canadian patent no. 855,961, it is preferable that in a tremolo of this invention, each string support plate be provided with a tremolo lever extending to one side of the plate and configured to be engaged within a cavity in the instrument body. Preferably, each a tremolo lever will be connected to the instrument body by resilient means such as is described in U.S. Pat. Nos. 2,741,146; 4,171,661; and, 4,939,971. Stabilizers for the springs may also be employed, such as those described in U.S. Pat. Nos. 4,928,564 and 5,127,298. In addition, resilient means may be provided having an effect on the tremolo lever opposite to the aforementioned springs, such as the tremolo lever return devices described in U.S. Pat. Nos. 4,555,970 and 4,823,669.

The string support plates of this invention are typically arranged in side by side relationship so as to affect adjacent groups of strings on an instrument. It is preferable that each string support plate of this invention be engageable with an adjacent string support plate by locking means which may be used to transmit pivotal movement from one plate to an adjacent plate. When such locking means is disengaged, independent movement of the plates is possible. Thus, a tremolo of this invention may be converted from one providing the tremolo action of this invention to one where actuation of the tremolo affects all of the strings of the instrument as in the prior art. Such locking means may comprise various known means in the art such as toggles, clamps, etc. A preferable locking means is a generally U-shaped clip slidably engaged on flanges or ridges on outer edges of adjacent string support plates and configured to slide onto one string support plate to disengage connection between adjacent plates.

The string support plates of this invention may be provided with integral means for restraining the end of an instrument string or for bridging the string. Preferably, such means is separable from the plate and may comprise a string saddle for tremolos such as those known in the art. The string support plate of this invention may be provided with fixation means such as threaded holes, for receiving fasteners or other fastening means for retaining a string saddle on the plate. An example of a string saddle which may be employed with this invention is that described in U.S. Pat. No. 4,497,236. Other modern string saddles may be employed with advantage in this invention such as that described in U.S. Pat. No. 5,109,745 and the saddle described herein.

It may be desirable to provide intermediate support means for a pivot element of this invention which means is situated between adjacent string support plates. Thus, in the case of a tremolo having two adjacent string support plates, support for the tremolo on the body of the instrument may be provided at opposite sides of the tremolo and at a point between adjacent string support plates. In the case of a tremolo of this invention designed to be engaged within a cavity in the instrument body, the intermediate support element may be configured to be mounted to the instrument body either within the cavity, or on a portion of the instrument body situated between adjacent cavities.

It may be desirable to provide a tremolo of this invention in a form which may be readily mounted on pre-existing instrument bodies. It may also be desirable to provide such a tremolo in a kit including threaded fasteners and other mounting elements such as spacing devices to permit attachment of the tremolo to the body of one or more pre-existing instruments. It may also be desirable to provide mounting means for the pivot means of this tremolo which is complementary to mounting means for tremolos provided on pre-existing instrument bodies. For example, a tremolo of this invention may be provided with a bracket pivotally engaged with the string support plates of the tremolo wherein, the bracket is configured to be readily attached by threaded fasteners or threaded insert/fastener combinations in pre-existing mounting holes on the upper surface of a particular instrument. An example of such pre-existing mounting holes would be ones configured to engage with the waisted pin or screwhead described in U.S. Pat. No. 4,171,661 for engagement with a fulcrum ridge or knife-edge fulcrum of a known tremolo.

This invention may be constructed from materials suitable for tremolo construction. Preferably, the tremolo will be made from metallic material such as iron, steel, or brass. It is desired to use hardened elements for knife-edged fulcrums and where a hinge is provided, it may be desirable to use suitable metallic material for hinges, such as brass. A preferable material for construction of a tremolo of this invention is stainless steel.

DESCRIPTION OF A PREFERRED EMBODIMENT

FIG. 1 shows a typical electric guitar having body 1 and neck 2. String 3 is one of a plurality of strings extending longitudinally along the neck to the body. In this case, the guitar is a six-string guitar. One end of each string is engaged on a string tuning peg 4 and is supported by a bridge means at the neck by nut bridge 5. The opposite end of each string is engaged on a tremolo of this invention comprising adjacent string support plates 6 and 7. Each string terminates in a string saddle 8 providing means to fix the end of a string and a bridge element to support the string. Thus, the string is suspended under tension between bridge elements at the tremolo and the neck. One or more transducers or "pick-up" elements 11 are situated beneath the suspended strings adjacent the tremolo. Each tremolo string support plate is pivotally engaged with the guitar body with their pivotal movements independently actuated by tremolo arms 9 and 10 acting as levers on the string support plates.

Figure 2:
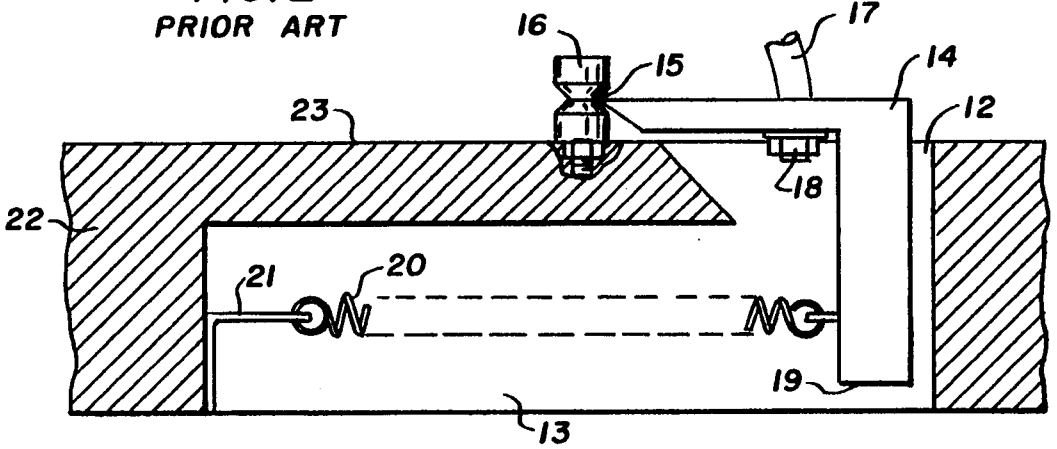
FIG. 2 PRIOR ART
FIG. 2 is a partial sectional view of a guitar body as taken along line 2—2 of FIG. 1 showing a guitar body cavity showing a form of tremolo known in the prior art in side elevational view engaged in the cavity.

FIG. 2 illustrates a portion of a guitar body having a cavity configured to receive a prior art tremolo known as a floating tremolo. The tremolo comprises a string support plate 14 wherein tremolo arm 17 is engaged in collar 18. The leading edge 15 of the tremolo comprises a knife-edge fulcrum which is pivotally engaged with the waist of pin 16 fixed to top surface of the guitar body. Tremolo lever means is provided by flange 19 extending from a side of the string support plate facing the cavity. The flange extends into cavity 13 through opening 12 in the top surface of the guitar body. Bracket 21 is fixed to a wall of the cavity. One or more springs 20 extend from bracket to the flange. String restraining means (not illustrated) will be provided on the side of the string support plate 14 opposite the cavity, which means may comprise a saddle consisting of means for clamping the end of a string and a bridge for the string. When such a saddle is engaged with plate 14 with tuned strings attached thereto, the tension of spring 20 counteracts the tension of the tuned strings to maintain the tremolo at a neutral floating position as is shown in FIG. 2.

Figure 3:
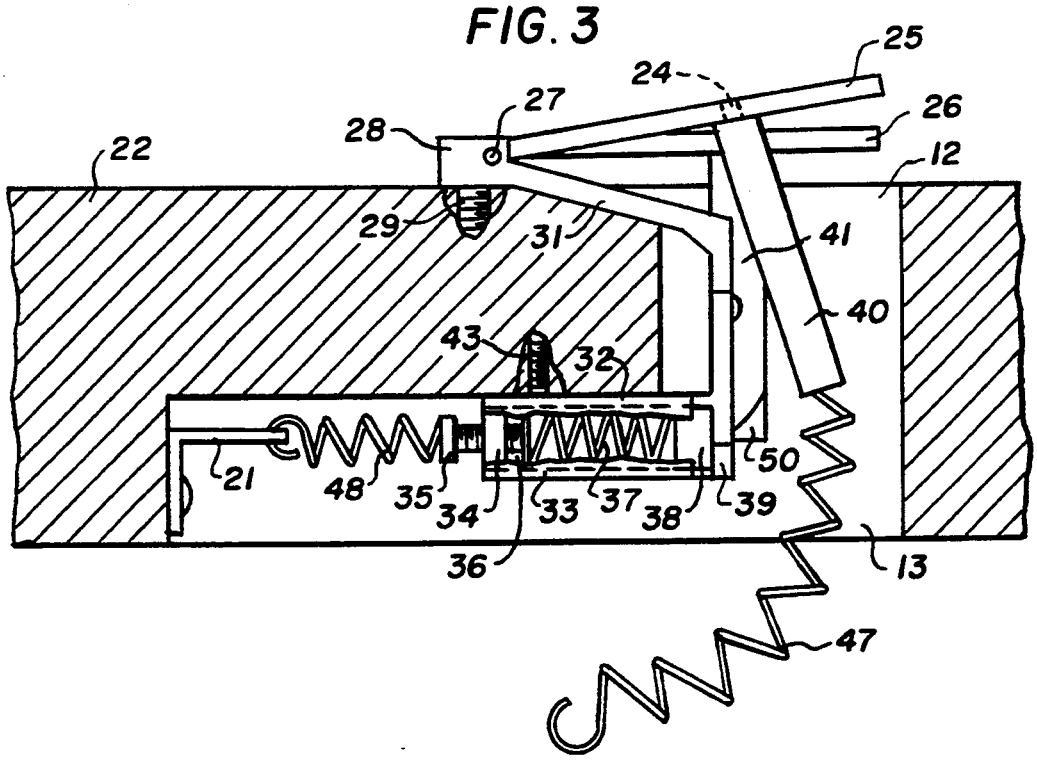
FIG. 3 is a partial sectional view of a guitar body as in FIG. 2 showing a tremolo of this invention in side elevational view engaged in the guitar body cavity.
Figure 4:
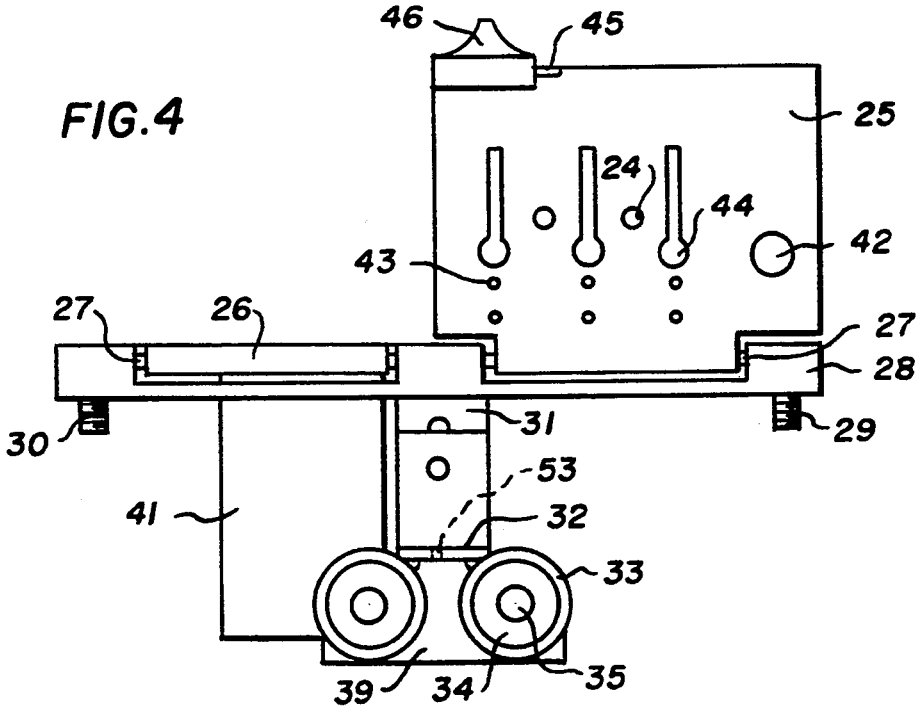
FIG. 4 is a front elevational view of a tremolo of this invention showing a string support plate pivoted in an upwards direction.

FIGS. 3 to 7 illustrate a preferred form of a tremolo of this invention. Referring to FIGS. 3 and 4, the tremolo comprises two string support plates 25 and 26, with plate 25 shown pivoted in an upwards direction. Each string support plate is supported by hinge pin 27 engaged in cylindrical apertures in bracket 28 which is provided with vertical through-holes configured to receive threaded fasteners 29 and 30 for attachment of the tremolo to a guitar body. Also supporting the tremolo is intermediate support element 31 which is a bracket extending into cavity 13. The lower portion of the intermediate support element is a bracket 32 which supports a tremolo return means and is mounted within the cavity by threaded fastener 43 in through-hole 53. The tremolo return means comprises a pair of guide tubes 33 of which one such tube is shown in partial section in FIG. 3. One end of each guide tube is closed with threaded removable end wall 34 each having a threaded through-hole receiving adjustment screw 35 which extends to, and is rotatably engaged with piston 36 on a compression spring 37 within the tube. Spring 37 extends to piston 38 placed in an open end of the tube 33. Piston 38 has a flat outer face which partially engages with, and is stopped by lateral appendage 39 of bracket 32. Extending downwards from one side of each string support plate 25 and 26 are flanges 40 and 41, each acting as tremolo levers and are configured to abut the flat outer face of a piston 38 in the tremolo return means above appendage 39, when the plate is pivoted towards cavity 13. Thus, in FIG. 3, flange 40 will be stopped by piston 38 when plate 25 is pivoted downwards. Each of flanges 40 and 41 have a curved cutaway or profiled portion 50 at adjacent bottom corners to facilitate clearance of lateral appendage 39 of the intermediate support. The flanges are removable from the string support plates and are retained by threaded fasteners placed in holes 24 in each plate.

Each string support plate is provided with tremolo arm engagement means such as a collar or through-hole 42. Each string support plate is provided with means for attachment of at least three string saddles comprising a plurality of threaded through-holes 43 configured to receive threaded fasteners for fixing a string saddles to the plate and, a plurality of key-hole slots 44 in the plate configured to receive button or T-shaped element on each string saddle. In practice, a button or T-shaped element of the saddle is engaged in an enlarged portion of slot 44, the saddle is then slid towards a narrowed portion of slot. The saddle is then fixed at an optimum position for harmonic tuning of a string by a means of a threaded fastener engaged with the string saddle and hole 43.

A rear edge of each plate is provided with flange 45 configured to be engaged within the bight of a U-shaped clip 46. Clip 46 is retained by the flange and is slidable along the flange and clip 46 may be urged to overlap the rear edges of both plates 25 and 26 by engaging a similar flange on the rear edge of plate 26 in order to lock the plates together.

As shown in FIG. 4, hinge pin 27 extends across the tremolo and is engaged in cylindrical through-holes in the leading portions of plates 25 and 26 and in bracket 28.

Engaged in holes in bottom surfaces of each of levers 40 and 41 respectively, are coil springs 47 and 48 with spring 47 shown detached from the guitar body. Spring 48 is shown attached to bracket 21 fixed to a wall of cavity 13. Each of springs 47 and 48 serve to counteract the tension of the instrument strings engaged with plates 25 and 26 respectively.

Figure 5:
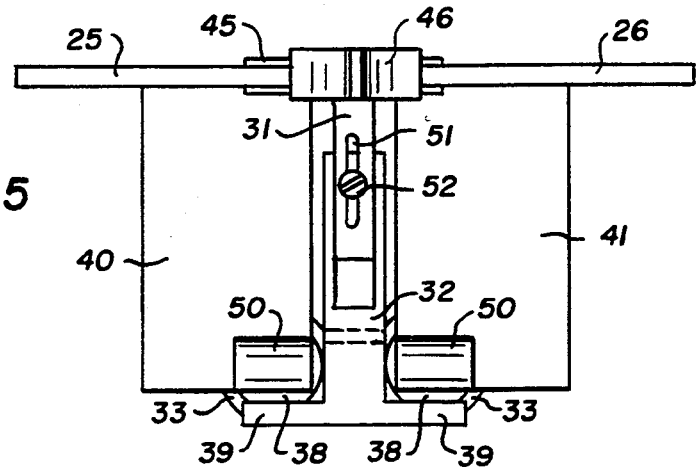
FIG. 5 is a rear elevational view of a tremolo of this invention.

As is shown in FIG. 5, each piston 38 abuts lateral element 39 which is part of an inverted T-shaped portion of the bracket 32. When flanges 40 and 41 are in a neutral position, they will also abut pistons 38. As is shown in FIGS. 3 and 5, of each of flanges 40 and 41 is profiled at a lower corner in curved area 50 to facilitate clearance of the T-shaped element by the flanges. When plates 25 and 26 pivot downwards, they force pistons 38 into their respective tubes 33 against springs 37 in each of the tubes. When released, springs 37 urge the flanges back to the neutral position. Adjustment screws 35 may be used to adjust the compression of springs 37.

As is shown in FIG. 5, intermediate element 31 with bracket 32 comprises separate, slidably engaged parts. As is illustrated in the embodiment, the upper part engages in a channel in the lower part, with the upper part having an elongated passage 51 accommodating the shaft of a screw fastener 52 threaded to the lower part. This allows for adjustment of the height of intermediate support element to facilitate attachment of the tremolo within the body cavity of a variety of pre-existing instruments. To facilitate adjustment, flanges 41 and 42 may be provided in a variety of lengths or with suitable spacing elements to be placed between the flange and the plate.

Figure 6:
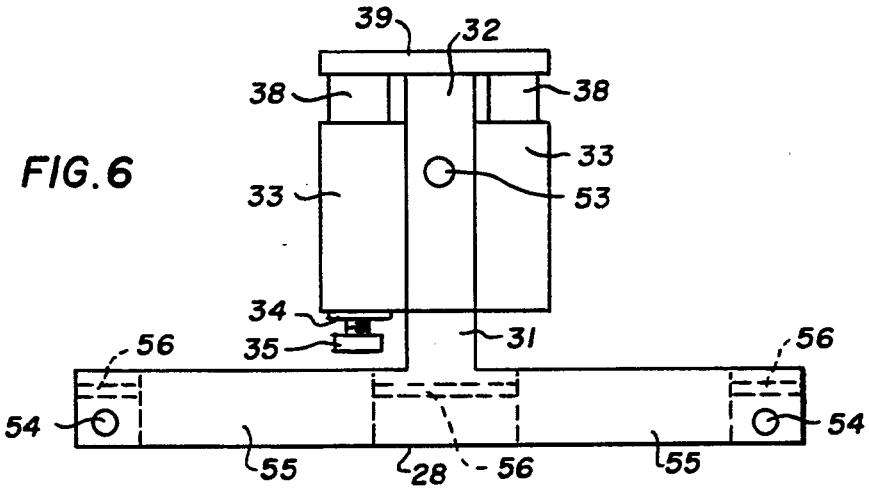
FIG. 6 is a bottom view of the tremolo of this invention without string support plates.

A tremolo of this invention is illustrated in bottom view in FIG. 6 wherein the string support plates have been removed. Bracket 32 includes a plate to which tubes 33 are attached, each housing a compression spring. The end of one tube is shown with threaded end plate 34 and adjustment screw 35 in place. The end the other of tube is shown with the end plate removed which facilitates placement of the spring and pistons in the tube. Pistons 38 are shown abutting appendage 39 of the T-shaped portion of bracket 32. Through hole 53 is provided to receive a screw fastener for attachment of bracket 32 to the guitar body. Bracket 28 is shown attached to the intermediate support element 31 with through holes 54 for receiving threaded fasteners for attachment of the tremolo to the upper surface of a guitar body. Shown in phantom outline on bracket 28, are recessed regions 55 which underlie the string support plates and cylindrical through holes 56 which receive the hinge pin.

Figure 7:
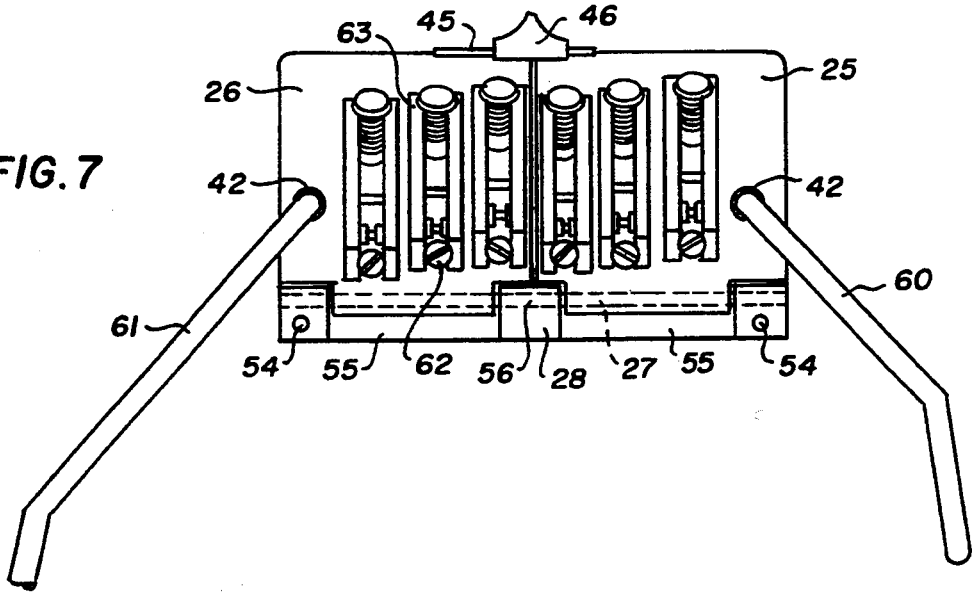
FIG. 7 is a plan view of a tremolo of this invention with string saddles and tremolo arms engaged on string support plates.
Figure 8:
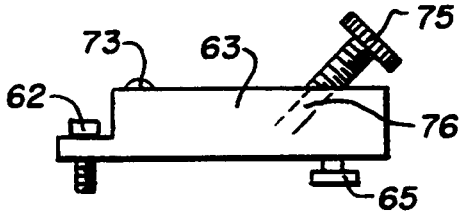
FIG. 8 is a side elevational view of a guitar string saddle according to this invention.

FIG. 7 shows the tremolo illustrated in FIGS. 3–6 with tremolo arms 60 and 61 engaged in collars 42 on string support plates 25 and 26. Clip 46 is shown engaged with flanges 45 on the rear edges of both string support plates. Mounted on each of the plates are three string saddles 63 of the kind illustrated in FIGS. 8–11. Each string saddle is fixed in an appropriate position for harmonic tuning by means of a threaded fastener, such as the one illustrated as part 62 which is engaged in a clevis on the saddle and a threaded through-hole in the plate. Hinge pin 27 is illustrated in phantom outline inserted in cylindrical through holes at the leading edge of plates 25 and 26 and in the bracket 28.

It may be desirable in some cases to provide cushioning or dampening material between a tremolo of this invention and a guitar body. Suitable material may be pads of nylon, rubber, or felt situated between bracket 32 and points on the guitar body to which the bracket is fixed.

Figure 9:
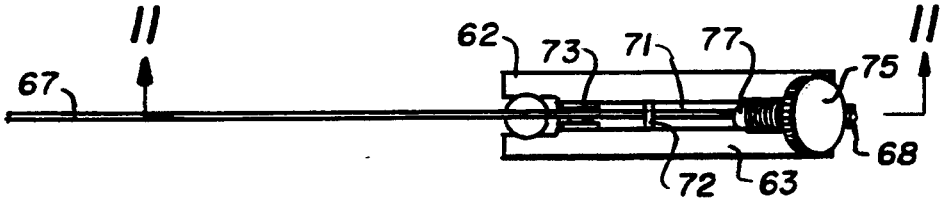
FIG. 9 is a top plan view of a guitar string saddle according to this invention with an engaged guitar string.
Figure 10:
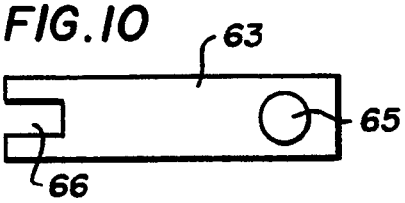
FIG. 10 is a bottom plan view of a guitar string saddle of this invention.
Figure 11:
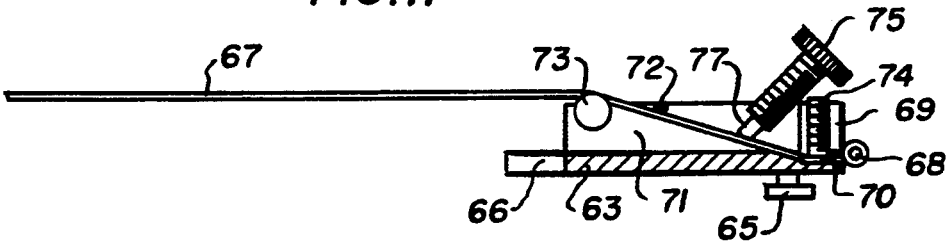
FIG. 11 is a sectional view taken along line 11—11 of FIG. 9.

FIGS. 8–11 illustrate a preferred saddle. As is shown in FIGS. 7, 9, and 10, button 65 extending from a bottom surface of saddle 63 has a T-shaped profile and is configured to engage in slot 44 shown in FIG. 4. Clevis 66, as illustrated in FIG. 10, receives a threaded fastener for fixation of the saddle to a string support plate of the tremolo. The saddle is shown with an engaged guitar string 67 in FIGS. 9 and 11. String button 68 attached to an end of string is retained by endwall 69 of the saddle. The string extends through passage 70 in the endwall to channel 71, in which is situated guide pin 72 and a spool-shaped bridge element 73. The string passes under the guide pin and over the bridge element with the guide pin serving to retain the string on the bridge element when the plate on which the saddle is mounted is pivoted in an upwards direction.

Set screw 74 is threaded into a cylindrical aperture at the end of the saddle so as to clamp the string in passage 70 providing further means to restrain the string. Thumbscrew 75 is threaded into a part-cylindrical passage 76 angled from the saddle top surface into channel 71. The diameter of passage 76 exceeds the width of channel 71. The end of a shaft of thumbscrew 75 abuts the string in the channel. Preferably, a cushion 77 of suitable material such as nylon or felt is provided at the end of the shaft for engagement with the string. Thumb screw 75 is used to fine tune string tension by pressing the string to alter its tension.

When the saddles illustrated herein are used with a tremolo of this invention, it is possible to quickly change an instrument string by threading the string through passage 70 into cavity 71 of the saddle. The string is then passed under guide pin 68 and over bridge element 69 and is extended along the instrument neck for attachment to the appropriate tuning peg. It is not necessary to remove the saddle from the tremolo or to pivot the tremolo in order to access passage 70 in the saddle rear wall. Use of both the string nut 64 and the set screw 71 for clamping the string provides secure fixation of the string at the saddle.

The following is as an example of the use of a tremolo of this invention on a 6-string guitar in a case where the string support plates of the tremolo are not engaged and are independently moveable. When the user strums a 6-string chord (E), the top three strings of the guitar are the base notes, E, A, and D. When the user operates the portion of the tremolo effecting the bottom three strings (G, B, E), the user may produce two styles of sounds simultaneously. Rhythm is provided with the base notes and lead with the strings on which the tremolo is operated.

All published documents and patent specifications referred to herein are incorporated by reference.

Various modifications and changes may be made in the tremolo described above and all such changes and modifications coming within the spirit of the invention and the scope of the appended claims are included within this invention.

We claim:

1. A tremolo for a multiple stringed musical instrument comprising a plurality of independently movable string support plates, each string support plate having means for attachment of a tremolo arm to the plate and hinge means for pivotal connection of the plate to a body of the musical instrument, wherein said hinge means comprises a hinge element common to each of the string support plates and extending from a first side of the tremolo to a second side of the tremolo and for supporting the string support plates on an instrument body.

2. The tremolo of claim 1, having locking means engageable between each adjacent string support plate to transmit pivotal movement from one plate to an adjacent plate.

3. The tremolo of claim 2, wherein each string support plate additionally comprises bridge means for supporting one or more instrument strings on the string support plate and retaining means for fixation of each of said strings to the tremolo.

4. The tremolo of claim 1 having two string support plates.

5. The tremolo of claim 4 in combination with a guitar wherein each string support plate comprises bridge means and retaining means for at least three guitar strings.

6. The tremolo of claim 1, wherein the common hinge element is a pin having ends engaged in one or more brackets at one or both of the first and second sides of the tremolo.

7. A tremolo for a multiple stringed musical instrument comprising a plurality of independently movable string support plates, each string support plate having means for attachment of a tremolo arm to the plate and means for pivotal connection of the plate to a body of the musical instrument, wherein each string support plate has a tremolo lever extending from a lower surface of the plate, each tremolo lever being configured to be connected by resilient means to an instrument body, and wherein the tremolo includes a supporting bracket between adjacent string support plates extending in the direction of the tremolo lever, the supporting bracket being mountable within a cavity in the instrument body.

8. The tremolo of claim 7, wherein the resilient means is a spring engageable in a hole in a side of the lever away from the plate.

9. The tremolo of claim 7, wherein the supporting bracket includes one or more compression springs and guide means for each spring, wherein each spring is configured to urge a tremolo lever to a neutral position.

10. The tremolo of claim 9, in combination with a guitar having a cavity configured to receive each tremolo lever and the supporting bracket, wherein the tremolo has two string support plates, each support plate comprising bridge means for supporting three adjacent guitar strings and retaining means for fixation of each string to the tremolo and wherein each tremolo lever is connected to a wall of the cavity by a spring under tension to urge the lever towards the wall of the cavity, and wherein each compression spring on the supporting bracket is configured to urge the lever away from the wall.

11. A tremolo for a multiple stringed musical instrument comprising a plurality of movable string support plates, each string support plate having means for attachment of a tremolo arm to the plate and hinge means for pivotal connection of the plates to a body of the musical instrument, wherein said hinge means comprises a hinge element common to each of the string support plates and extending from a first side of the tremolo to a second side of the tremolo and for supporting the string support plates on an instrument body, and wherein each string support plate has a tremolo lever extending from a lower surface of the plate, each tremolo lever being configured to be connected by resilient means to an instrument body, and wherein the tremolo further including a supporting bracket between adjacent string support plates extending in the direction of the tremolo lever, the supporting bracket being mountable within a cavity in the instrument body.

* * * * *